US006055983A

United States Patent [19]

Metzger

[11] Patent Number: 6,055,983

[45] **Date of Patent: *May 2, 2000**

[54] RESPIRATOR FILTRATION DEVICE

[75] Inventor: Karl Metzger, Lenexa, Kans.

[73] Assignee: Parmelee Industries, Lenexa, Kans.

[ * ] Notice: This patent is subject to a terminal disclaimer.

[21] Appl. No.: 08/998,921

[22] Filed: Dec. 29, 1997

Related U.S. Application Data

[63] Continuation of application No. 08/814,347, Mar. 11, 1997, Pat. No. 5,732,695.

[51] Int. Cl.[7] ..... A62B 7/00

[52] U.S. Cl. ..... 128/206.17; 128/206.12; 128/206.15; 128/206.16

[58] Field of Search ..... 128/206.17, 206.12, 128/206.15, 206.19, 203.12, 205.25, 205.23, 205.28, 205.29, 201.23, 206.16

[56] References Cited

U.S. PATENT DOCUMENTS

| | | | |
|---|---|---|---|
| Re. 35,062 | 10/1995 | Brostrom et al. | 128/206.12 |
| 2,142,064 | 12/1938 | Whipple | 128/206.16 |
| 2,227,959 | 1/1941 | Cover . | |
| 4,873,972 | 10/1989 | Magidson et al. | 128/206.12 |
| 4,883,052 | 11/1989 | Weiss et al. | 128/205.27 |
| 4,886,058 | 12/1989 | Brostrom et al. | 128/206.12 |
| 5,732,695 | 3/1998 | Metzger | 128/206.12 |

FOREIGN PATENT DOCUMENTS

| | | |
|---|---|---|
| 470850 | 9/1937 | United Kingdom . |
| 1041394 | 9/1966 | United Kingdom . |

*Primary Examiner*—John G. Weiss
*Assistant Examiner*—V. Srivastava
*Attorney, Agent, or Firm*—Shook, Hardy & Bacon, LLC

[57] ABSTRACT

A novel filtration device having a substantially rigid frame comprised of an outer peripheral band connected by a plurality of spacers to an inner breather tube, wherein filter pads are secured over both sides of the frame and separated by the spacers to form an enclosed central air pocket accessible only through the breather tube. The breather tube is adapted to be detachably connected to an inlet port in a respirator face mask so as to provide a closed channel for air flow from the central air pocket to the interior of the face mask.

17 Claims, 2 Drawing Sheets

RESPIRATOR FILTRATION DEVICE

This is a continuation of application Ser. No. 08/814,347, filed Mar. 11, 1997 now U.S. Pat. No. 5,732,695.

BACKGROUND OF THE INVENTION

1. Field of the Invention

The present invention is directed to a detachable filtration device for use with a respirator, wherein the filtration device has a rigid frame structure that enhances overall performance and use of the respirator.

2. Description of Related Art

Respirators are commonly employed to filter the air inhaled by a user under hazardous breathing conditions such as in environments having noxious vapors or particulates suspended in the air. A conventional respirator includes a face mask which covers the nose and mouth of the user. This face mask has one or more inlet valves through which air is drawn as the user inhales, and an outlet valve through which air exits the face mask as the user exhales. A filtration device is connected (either integrally or detachably) over the inlet valve so as to form a closed air channel between the filtration device and the interior of the face mask. In this manner, air is first drawn through the filtration element and filtered as the user inhales.

A key consideration in designing respirator filtration devices is filtering efficiency. The filtration device must be capable of removing a sufficient amount of contaminants from the air so as to supply "safe" breathing air to the user as prescribed by applicable statutes and regulations. Enhanced filtering efficiency is often obtained by utilizing highly efficient filter materials such as a tightly webbed or woven materials and to use multiple layers of the filter material. However, by using these tightly webbed and multiple layers of material, the effort required by the user to draw a sufficient volume of air through the material (also known as breathing resistance) is likewise increased.

Thus, a competing interest or consideration in designing filtration devices has been to reduce the amount of breathing resistance provided by the filtration device. Breathing resistance has been quantified as the pressure drop across the filtration element—the larger the difference in pressure between the air outside the filter and the air inside the filter at a given volumetric flow rate, the greater the breathing resistance experienced by the user.

In order to reduce this pressure drop, more recent designs have attempted to increase the overall filtration surface area of the device. This has been accomplished by providing a device comprised of two filter pads secured along their outer edges to face opposing directions. (See, e.g., U.S. Pat. No. Re. 35,062). The filter pads are separated by spacers or a baffle to form an interior region in which the air may be drawn through the filters. A breather tube is provided through one of the pads to connect this interior region with the inlet valve of the respirator face mask. As the user inhales, air is drawn through the surfaces of both filter pads into the interior region then drawn through the breather tube into the face mask via the inlet valve.

While this prior art design is useful in reducing breathing resistance without significantly detracting from filtration efficiency, a need remains in the art to develop even better designs having improve performance and use characteristics. For instance, the filtration device is generally secured to and disconnected from the respirator face mask by connecting the breather tube to the respirator using a threaded or bayonet type fitting. In doing so, the user must grasp and touch the filter pads and twist or otherwise manipulate the device to make the connection. This means that any soil on the user's hands can contaminate the filter pads, potentially blocking a portion of the available filtration surface area and reducing filtration efficiency in use. In disconnecting a spent device from the respirator, the user's hands may come into contact with potentially harmful material deposited on the used filter pads. Handling the filters may also cause particles on the pads to flake off and/or become airborne so as to present harm to a bystander or to the user who has removed his or her respirator while replacing the filtration device.

In twisting or otherwise manipulating the device for connection or disconnection with the respirator face mask, the pliable filter material tends to be rotated or turned further than the relatively stiff breather tube being connected, thereby placing stress on the filter material surrounding the breather tube. This relative rotational stress on the filter material can potentially lead to tearing or other damage of the material and possibly even separation of the filter material from the breather tube.

Thus, preventing user contact with the filter material, bending of the filter material during removal and attachment, and relative rotation between the filtration material and the breather tube are desirable objectives to enhance the overall performance and use of the filtration device. Of course, it is likewise an important objective to maintain filtration efficiency while reducing breathing resistance, and to increase the overall filtering surface area while making the filtration element relatively compact so as not to obstruct the user's view or otherwise frustrate the user's ability to work when wearing the respirator.

SUMMARY OF THE INVENTION

These and other objectives are met by a novel filtration device having a substantially rigid frame comprised of an outer peripheral band connected by a plurality of spacers to an inner breather tube, wherein filter pads are secured over both sides of the frame and separated by the spacers to form an enclosed central air pocket accessible only through the breather tube. The breather tube is adapted to be detachably connected to a valve regulated inlet port in a respirator face mask so as to provide a closed channel for air flow from the central air pocket to the interior of the face mask.

The rigid spacers keep the filter pads separated so as to maintain good air flow and prevent collapse of the filter pads into the central air pocket. This assures that the pressure drop across the filtration device and associated breathing resistance is minimized. Separating the filter pads also prevents premature loading (an increased concentration of filtered contaminants) of the filter material immediately opposite the breather tube.

The filter pads are preferably secured within the confines of the outer peripheral band so that the filtration device can be grasped along the band without contacting the filter pads, and most preferably are secured such that the outer edges of the filter pads are covered by the band. The outer peripheral band may include exterior ridges, protrusions or other surface texture to assist the user in holding the filtration device. Insofar as the outer band is rigidly connected to the breather tube via the spacers, the filtration device can be connected to and disconnected from the respirator face mask without twisting or otherwise manipulating the filter pads.

In one embodiment of the invention, the filtration device is disk shaped, wherein the outer band comprises an outer ring. The breather tube is provided in an offset position remote from the central axis of the frame so that when the filtration device is connected to the respirator face mask, a large portion of the filtration device is positioned downward away from the user's line of vision. The spacers extend radially outward from the breather tube to the outer band so as to provide a rigid and stable frame, while maintaining as much open space within the central air pocket as possible.

In a preferred embodiment, at least a portion of the rigid spacers have a diamond shaped cross section so that only the sharp edge of the spacer actually comes into contact with the filter material. The spacers therefore maintain the filter pads separated without significantly blocking and reducing the overall filtration surface area.

The present invention further encompasses a novel respirator having a respirator face mask with an exhalation port to permit the flow of air out of the respirator, at least one inhalation port to permit the flow of air into the respirator, and a means for securing the face mask over the mouth and nose of the user. Each inhalation port is connected to a filtration device as described above to permit the flow of air through the filtration device and into the interior of the respirator face mask as the user inhales.

BRIEF DESCRIPTION OF THE DRAWINGS

These and other features, advantages, and objects will appear from the following Detailed Description when considered in connection with the accompanying drawings showing a preferred embodiment of the invention, in which similar reference characters denote similar elements throughout the several views and wherein.

DETAILED DESCRIPTION OF THE DRAWINGS

Figure 1:
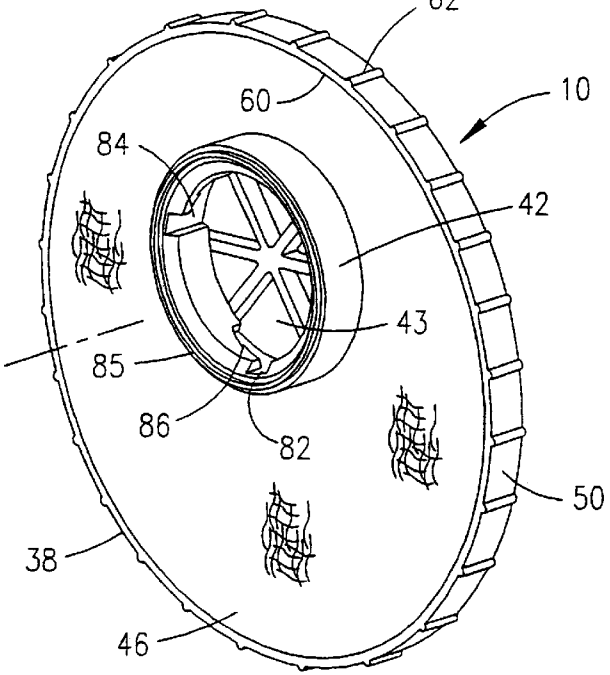
FIG. 1 is a partially exploded perspective view of a respirator utilizing two filtration devices made in accordance with a preferred embodiment of the present invention.
Figure 1:
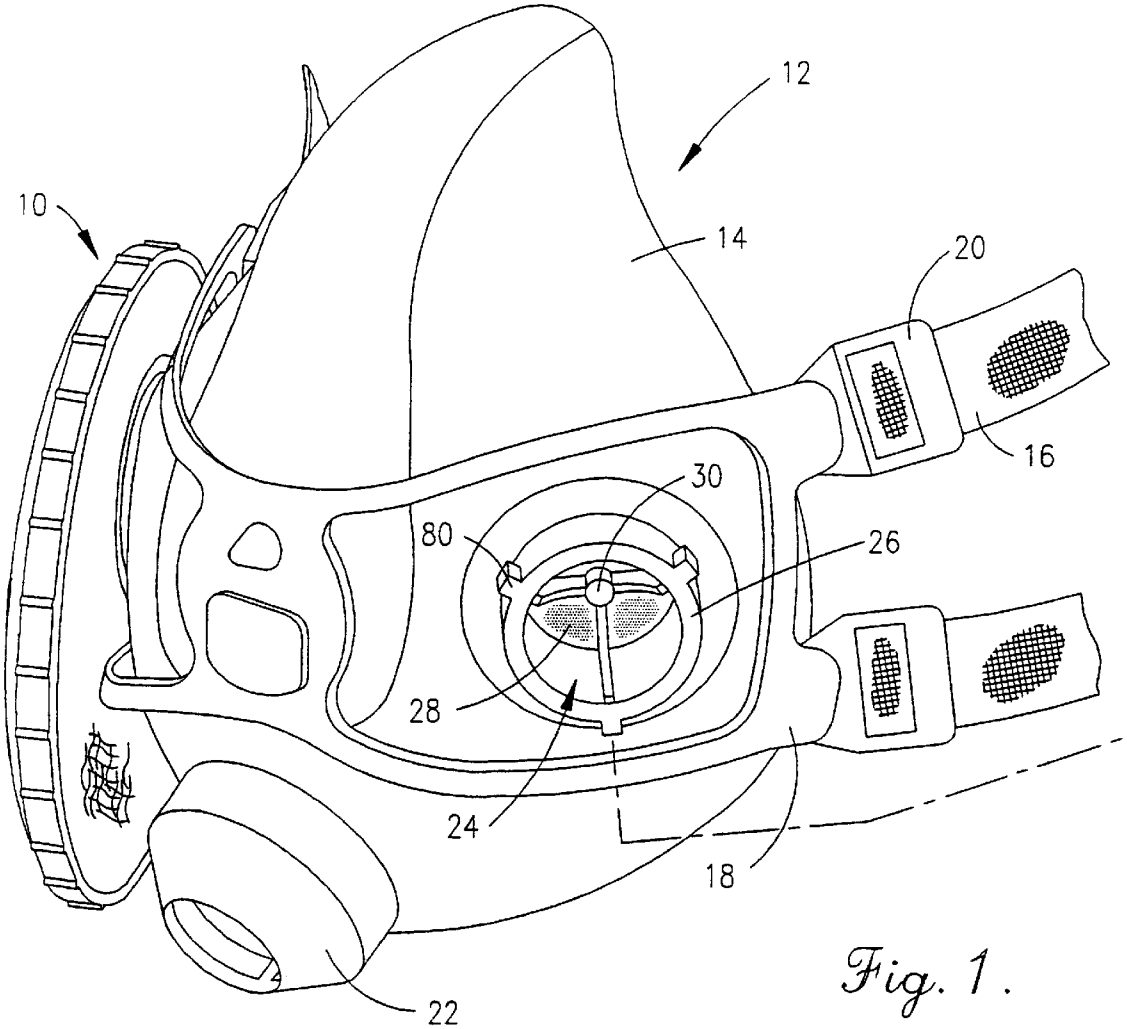

With specific reference to FIG. 1, two filtration devices made in accordance with a preferred embodiment of the present invention are each generally designated by the numeral 10, and shown adapted for detachable use with a conventional respirator 12. Respirator 12 comprises a face mask 14 configured to cover a user's nose and mouth and to create an airtight seal against the surrounding facial area of the user. Face mask 14 may be secured to the user by resilient straps 16 which attach to a flexible bracket 18 provided along the outer edge of the face mask. Straps 16 are preferably adapted to expand and fit around the head of the user thereby securing the face mask over the face of the user. The straps are preferably adjustable in length using a buckle or cinch means 20 as is known in the art. It should, of course, be understood that the filtration device of the present invention may be adapted for use with any conventional respirator. While the respirator is shown having two filtration devices, it is contemplated that a single filtration device may be used in some applications.

Face mask 14 includes an exhalation port 22 centrally located adjacent the user's mouth when in use and having a one-way valve through which exhaled air is permitted to exit but not enter the respirator. The face mask additionally includes two inlet ports 24 positioned on either side of the respirator so as to be positioned adjacent the user's cheeks when in use. Each inlet port 24 comprises an opening formed by rigid tubular port wall 26 extending outward from the front of the face mask. A one-way inhalation valve 28, preferably comprising a flexible diaphragm valve, is secured at the central axis of three leg attachment member 30 to cover the opening in a manner to allow air to be drawn into the interior of the face mask, but to prevent air from exiting through the opening. As is described in more detail below, filtration device 10 is adapted to be secured to port wall 26 so as to provide a closed channel for air flow from the filtration device through inlet port 24 into the interior of the face mask.

Figure 3:
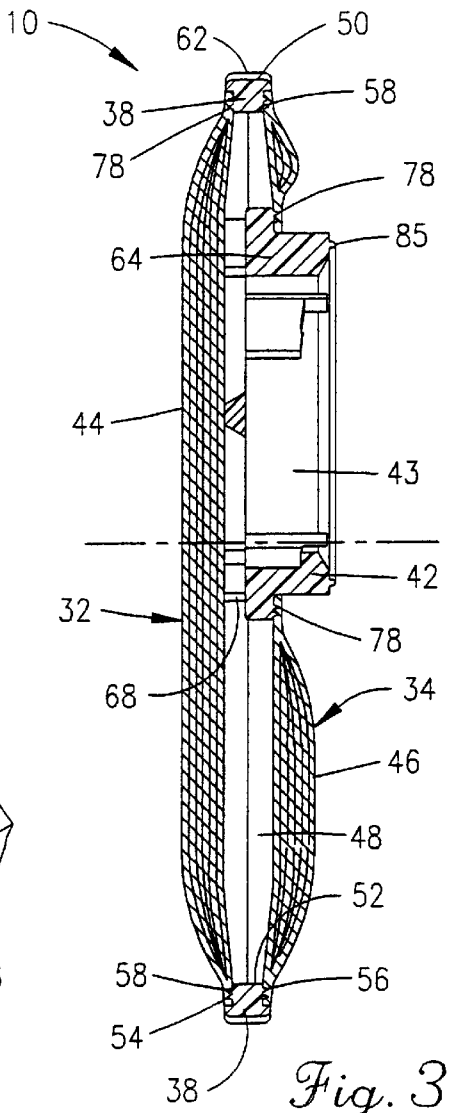
FIG. 3 is a cross-sectional view of the filtration device of FIG. 2 taken along line 3—3.
Figure 2:
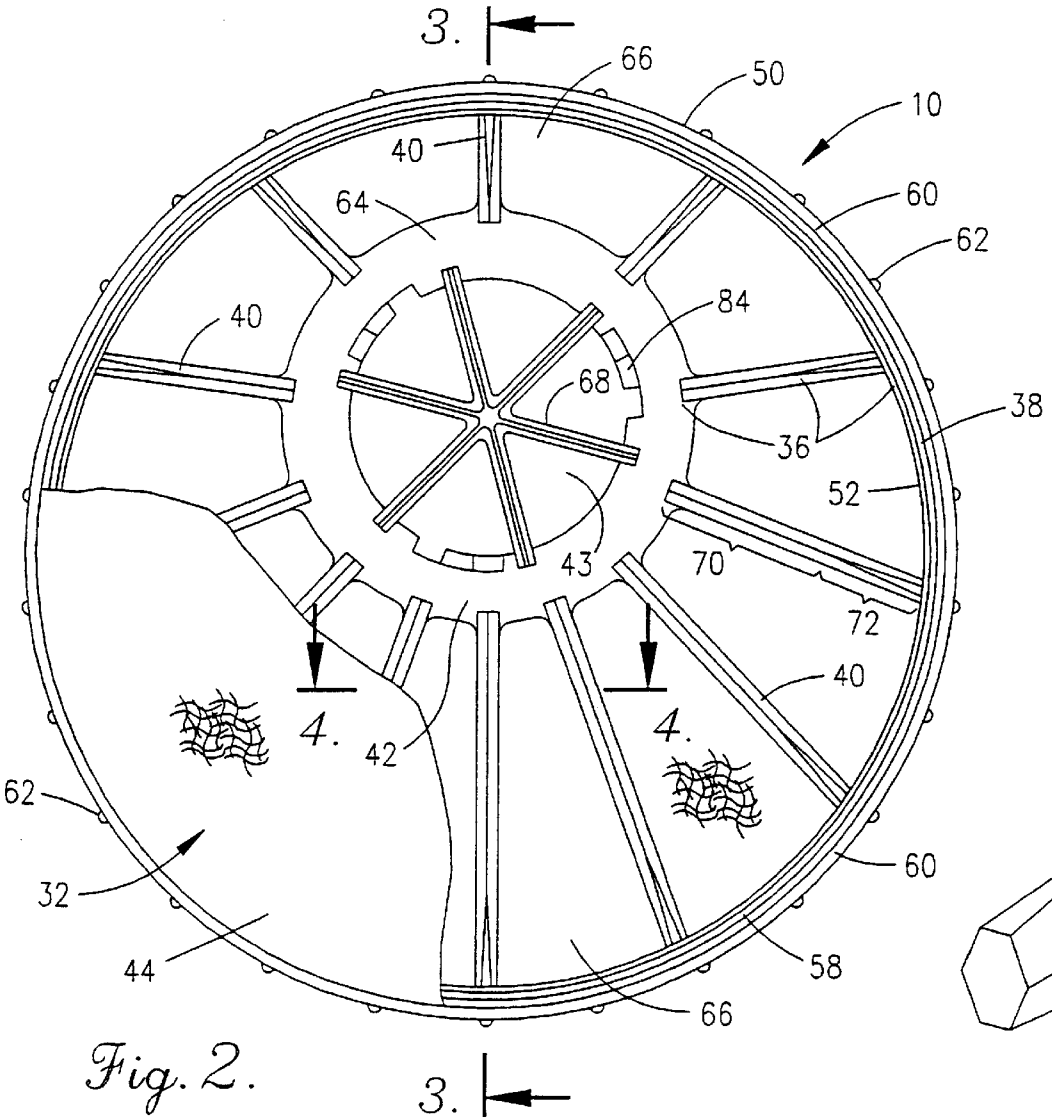
FIG. 2 is a front side elevational view of one of the filtration devices of FIG. 1 having a portion of the front filter pad partially removed.

With reference to FIGS. 2 and 3, filtration device 10 comprises a round disk having a front face 32 which faces forward when secured to the respirator face mask and a rear face 34 which faces the mask when secured in position. Device 10 has a substantially rigid frame 36 comprised of an outer ring-like band 38 connected by a plurality of spacers 40 to an inner breather tube 42 which projects outwardly from rear face 34 of device 10 for attachment to the respirator. Filter pads 44 & 46 are secured over the front and rear faces 32 & 34 of frame 36 respectively separated by spacers 40 so as to form an enclosed central air pocket 48 in communication with breather tube 42. The breather tube is adapted to be detachably connected to port wall 26 in a manner to provide a closed passageway for air flow from the central air pocket to the interior of the face mask through inlet pore 24.

Frame 36 may be constructed of any rigid relatively inert material known in the art including wood, metal, plastic or any combination of the same. The frame is preferably formed as a unitary component from a plastic material that can be easily molded or otherwise mass produced. In a preferred embodiment, the frame is molded as a single unit from a thermoplastic material such as polystyrene, polypropylene or polyethylene so that conventional ultrasonic welding and heat sealing techniques may be used to secure filter pads 44 & 46 to the frame.

Band 38 has an outer surface 50 which may be grasped by the user to hold the filtration device, an internal surface 52 to which spacers 40 are connected, and front and rear sidewalls 54 & 56 corresponding in direction to the front and rear faces 32 & 34 of the device respectively. Looking specifically to FIG. 3, band 38 is t-shaped in transverse cross-section so as to provide a peripheral groove 58 along the sidewalls 54 & 56 adjacent internal surface 52 of the band. A peripheral flange 60 is therefore formed by each sidewall 54 & 56 adjacent the outer surface 50 of band 38.

As shown in FIG. 1, outer surface 50 of band 38 includes a plurality of equally spaced apart ridges 62 which assist the user in grasping the filtration device. Of course other forms of surface texture including knurling, depressions, or other protrusions may be used for this purpose.

Breather tube 42 forms a tubular opening 43 projecting from the rear face 34 of the device and includes a circular mounting base 64 forming a peripheral flange along the inner end of the tube. Spacers 40 extending radially outward from mounting base 64 are connected to the internal surface 52 of band 38. The spacers 40 are configured to keep filter pads 44 & 46 separated when in use so as to maintain the central air pocket 48. A series of air channels 66 are formed in central air pocket 48 by the spacers 40 and each channel 66 opens into that region of air pocket 48 immediately adjacent breather tube opening 43. In order to enable filtered air to flow from channels 66 to breather tube opening 43, divided spacer 68 is secured over opening 43 along the inner surface of mounting base 64 to prevent front filter pad 44 from collapsing over the breather tube opening.

Figure 4:
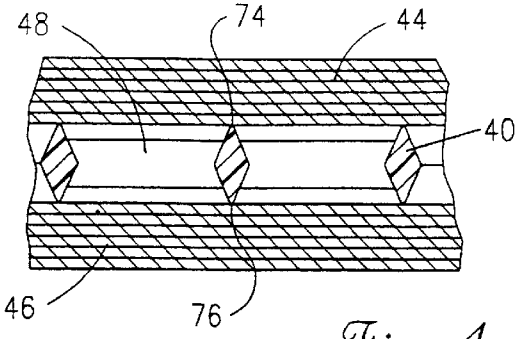
FIG. 4 is a fragmentary cross-sectional view of the filtration device of FIG. 2 taken along line 4—4.

Looking to FIG. 2, in the preferred embodiment of this invention, spacers 40 may be divided along their length into a first inner section 70 and a second outer section 72. Inner section 70 has a diamond shaped cross section as shown in FIG. 4 such that opposing pointed edges 74 & 76 are positioned in contact with filter pads 44 & 46 respectively. Thus, the spacer and filter pads contact along a fine line such that the available filtration surface area is not significantly blocked or reduced by the spacers.

Figure 5:
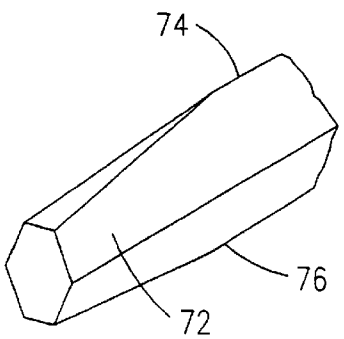
FIG. 5 is a fragmentary perspective view of a spacer of the filtration device of FIG. 2.

Looking to FIG. 5, pointed edges 74 & 76 in contact with the filter pads are gradually leveled or shaved within outer section 72 of the spacer as it approaches connection with outer band 38 thereby having a hexagonal cross section. The distance between the edges of the spacer in contact with the filter pads is therefore reduced so as to equal the transverse width or the interior surface 52 of band 38 at the point of connection. In this manner, filter pads 44 & 46 are brought closer together along the outer edges of the pads to assist in securing cads 44 & 46 to the outer band.

Filter pads 44 & 46 may be constructed of one or more layers of any known filter material. The type of filter material used will depend upon design factors such as the environment in which the filtration device is to be used, the type and amount of contaminates to be removed from the inhaled air, and any applicable statutory or regulatory requirements. While it is possible to utilize only a single layer of filter material, a plurality of layers enclosed by an outer scrim is preferred for high performance filtration devices. By using a plurality of layers of filter material, web irregularities which could lead to premature penetration of particles through a single layer of filter material are minimized.

Examples of suitable filter material include non-woven web, fibrillated film web, air-laid web, sorbent-particle-loaded fibrous web, glass, filter paper, or combinations thereof. The filter material may further comprise polyolefins, polycarbonate, polyesters, polyurethanes, glass, cellulose, carbon, lumina, or combinations thereof. Electrically charged non-woven microfiber webs may also be utilized.

Front filter pad 44 is configured to cover the entire front face 32 of frame 36 and rear filter pad 46 is configured to cover that portion of the rear face 34 of the frame extending from outer band 38 to breather tube 42. The filter pads are preferably seated into peripheral groove 58 such that the outer edges of pads 44 & 46 are covered by corresponding flange 60. Note that where the filter pads comprise multiple layers of material, the layers are tightly bound along the outer edges of the pads and flanges 60 are of sufficient dimension to assure that the outer edges of the filter pads are not exposed.

Filter pads 44 & 46 are secured to the sidewalls 54 & 56 of band 38 respectively by any means known in the art for providing an air tight seal including ultrasonic welding, heat sealing, gluing and mechanical pinch fitting. Rear filter pad 46 is also secured to form an air tight seal to the outer surface of mounting base 64 surrounding breather tube 42. In a preferred embodiment where frame 36 is constructed of a thermoplastic material, filter pads 44 & 46 are secured to sidewalls 54 & 56 and mounting base 64 by ultrasonic welding. In this embodiment, sharp protrusions 78 formed within peripheral groove 58 and on the outer surface of mounting base 64 serve as energy directors for welding attachment of the pads to the frame.

As shown in FIG. 1, breather tube 42 is detachably secured to the forward end of port wall 26 using a bayonet type fitting to provide a closed air channel between the face mask and central air pocket 48 of filtration device 10. Tabs 80 provided along the outer periphery of port wall 26 are configured to mate with slots 82 formed within the outer edge of the interior wall of breather tube 42. The breather tube is secured over the port wall by fitting each tab 80 into a corresponding slot 82 and turning the device such that tab 80 is conveyed along a track 84 extending from the inner end of slot 82 along the inner edge of breather tube 42. In the manner, the filtration device is pulled inwardly toward the respirator for a more secure attachment. Tab 80 is pushed over a step 86 provided along track 84 to snap tab 80 into a locking position against the end of track 84. Step 80 serves to prevent the filtration device from becoming inadvertently loosened wherein the step blocks accidental movement of the tab from the locking position. A peripheral ridge 85 extends outwardly along the outer end of breather tube 42 so as to form an air tight seal with the outer end of port wall 26.

In the preferred embodiment shown in the drawings, breather tube 42 is positioned asymmetrically or offset from the central axis of frame 36, and spacers 40 are of varying length in order to accommodate this offset position. By positioning the breather tube to be in this offset position, the breather tube may be secured to the face mask such that a significant portion of the device is positioned upwardly, downwardly, or to the side of the mask. In this embodiment, tabs 80 and slots 82 are preferably spaced symmetrically such that the individual user may choose the most desired orientation of the filtration device for use. For example, the user may desire to position a majority of the filtration device to the lower extent of the mask when being used with a welding helmet or to the side of the mask when being used with a face shield. Alternatively, tabs 80 and slots 82 may be asymmetrically spaced, so that the filtration device will attach to the respirator in only one pre-determined orientation.

To attach filtration device 10 to the respirator, the user grasps the device by outer band 38. The user then properly aliens tabs 80 and slots 82 of breather tube 42 and port wall 26 respectively. The user then rotates the filtration device 10 until tabs 80 lock into the locking position. Because frame 36 is substantially rigid, there is no relative rotation between outer band 38 and breather tube 42. This prevents any type of stress or twisting which could cause tearing or other damage to the filter material. With the filtration device 10 connected to respirator 12, no air can enter into the respirator except through the filtration device. As a user inhales, air is drawn from the surrounding environment through filter pads 44 & 46 and into the central air pocket 48. The filtered air is then drawn through the breather tube 42 into the interior of face mask 14 through inlet port 24.

To remove the filtration device, the user again grasps outer band 38 and rotates the device 10 to snap tabs 80 over step 86 and remove filtration device 10 from the respirator. Because the frame is rigid, the act of grasping and rotating the filtration device does not bend the filter pads or cause relative rotation between the outer band and the breather tube. Therefore, contaminants deposited on the filter pads are not disturbed and the integrity of the filter material is maintained.

While preferred embodiments and particular applications of this invention have been shown and described, it is apparent to those skilled in the art that many other modifications and applications of this invention are possible without departing from the inventive concepts herein.

For example, it should be understood that while the filtration device is shown in the drawings as having a circular or disk shaped configuration, the filtration device may be of any shape including octagonal, rectangular, or elliptical. In addition, while the preferred embodiment discloses attaching the breather tube to the inlet port using a bayonet type fitting, other means of attachment known in the art to provide a closed air channel between the face mask and the central air pocket of the filtration device are considered suitable for purposes of the invention. Furthermore, there may be certain situations where the filtration device will be made integral with the respirator.

It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A filtration device for use with a respirator, wherein said device comprises:

a rigid frame having a front face and a rear face, wherein said frame includes an outer peripheral band occupying at least 50% of an outer periphery of said frame, wherein said outer peripheral band is connected to an inner breather tube, said inner breather tube projecting from said rear face of said frame for attachment with a respirator;

a front filter pad covering the front face of the rigid frame; and a rear filter pad covering the rear face of the rigid frame.

2. The filtration device according to claim 1 wherein said front filter pad covers the entire said front face of said rigid frame.

3. The filtration device according to claim 1 wherein said front filter pad is secured to said front face of said rigid frame at said outer peripheral band.

4. The filtration device according to claim 1 wherein said rear filter pad covers a portion of said rear face of said frame extending from said peripheral band to said inner breather tube.

5. The filtration device according to claim 1 wherein said rear filter pad is secured to said rear face of said rigid frame adjacent to said breather tube and at said peripheral band.

6. The filtration device according to claim 1 wherein said peripheral band circumscribes the entire periphery of said frame.

7. The filtration device according to claim 1, further comprising at least one spacer connected to said outer peripheral band to provide a central air pocket between said front filter pad and said rear filter pad.

8. The filtration device according to claim 1, further comprising a plurality of spacers connected to said outer peripheral band to provide a central air pocket between said front filter pad and said rear filter pad.

9. The filtration device according to claim 8, wherein said plurality of spacers connect said outer peripheral band to said inner breather tube.

10. A filtration device for use with a respirator, wherein the device comprises:

a rigid frame having a front face and a rear face, wherein said frame includes an outer peripheral band connected to an inner breather tube, said inner breather tube projecting from the rear face of the frame for attachment with a respirator;

a front filter pad covering the front face of the rigid frame; and a rear filter pad covering the rear face of the rigid frame.

11. The filter device according to claim 10 wherein said front filter pad covers the entire said front face of said rigid frame.

12. The filtration device according to claim 10 wherein said front filter pad is secured to said front face of said rigid frame at said outer peripheral band.

13. The filtration device according to claim 10 wherein said rear filter pad covers a portion of said rear face of said rigid frame extending from said outer peripheral band to said inner breather tube.

14. The filtration device according to claim 10 wherein said rear filter pad is secured at said rear face of said rigid frame adjacent to said breather tube and at said peripheral band.

15. The filtration device according to claim 10, further comprising at least one spacer connected to said outer peripheral band to provide a central air pocket between said front filter pad and said rear filter pad.

16. The filtration device according to claim 10, further comprising a plurality of spacers connected to said outer peripheral band to provide a central air pocket between said front filter pad and said rear filter pad.

17. The filtration device according to claim 16, wherein said plurality of spacers connect said outer peripheral band to said inner breather tube.

* * * * *